US010981383B2

(12) United States Patent
Tsubota

(10) Patent No.: US 10,981,383 B2
(45) Date of Patent: Apr. 20, 2021

(54) LIQUID EJECTING HEAD AND LIQUID EJECTING APPARATUS

(71) Applicant: SEIKO EPSON CORPORATION, Tokyo (JP)

(72) Inventor: Shinichi Tsubota, Azumino (JP)

(73) Assignee: Seiko Epson Corpoation, Tokyo (JP)

( * ) Notice: Subject to any disclaimer, the term of this patent is extended or adjusted under 35 U.S.C. 154(b) by 0 days.

(21) Appl. No.: 16/705,968

(22) Filed: Dec. 6, 2019

(65) Prior Publication Data

US 2020/0180312 A1 Jun. 11, 2020

(30) Foreign Application Priority Data

Dec. 10, 2018 (JP) ..... JP2018-231094

(51) Int. Cl.
*B41J 2/14* (2006.01)

(52) U.S. Cl.
CPC ..... *B41J 2/1433* (2013.01); *B41J 2/14274* (2013.01); *B41J 2002/14419* (2013.01); *B41J 2202/11* (2013.01)

(58) Field of Classification Search
CPC ..... B41J 2/14274; B41J 2/1433; B41J 2002/14419; B41J 2202/11
See application file for complete search history.

(56) References Cited

U.S. PATENT DOCUMENTS 6,332,671 B1 * 12/2001 Takahashi ..... B41J 2/14274 347/68
2004/0114005 A1 6/2004 Okazawa et al.
2007/0024672 A1 * 2/2007 Hano ..... B41J 2/1628 347/55
2011/0187796 A1 * 8/2011 Akahane ..... B41J 2/04 347/54
2015/0283813 A1 * 10/2015 Oya ..... B41J 2/1631 347/47

FOREIGN PATENT DOCUMENTS

JP 2000006397 1/2000
JP 2004122396 4/2004

* cited by examiner

*Primary Examiner* — Anh T Vo
(74) *Attorney, Agent, or Firm* — Workman Nydegger

(57) ABSTRACT

A liquid ejecting head includes a nozzle plate having a plurality of nozzles, and a flow path plate bonded to one side of the nozzle plate, the flow path plate having flow paths including a liquid reservoir configured to store a liquid to be supplied to the nozzles, in which the liquid reservoir is defined by a concave portion disposed on a side of the flow path plate opposite to the nozzle plate, a bottom of the concave portion includes a first portion along a periphery of the concave portion and a second portion inside the first portion in plan view from a thickness direction of the flow path plate, and the thickness of the first portion is thicker than the thickness of the second portion.

10 Claims, 10 Drawing Sheets

LIQUID EJECTING HEAD AND LIQUID EJECTING APPARATUS

The present application is based on, and claims priority from JP Application Serial Number 2018-231094, filed Dec. 10, 2018, the disclosure of which is hereby incorporated by reference herein in its entirety.

BACKGROUND

1. Technical Field

The present disclosure relates to a liquid ejecting head and a liquid ejecting apparatus.

2. Related Art

Liquid ejecting heads for ejecting ink in a pressure chamber from nozzles by changing the volume in the pressure chamber by a piezoelectric element are known. For example, the head described in JP-A-2000-6397 includes a flow path unit and a piezoelectric vibrator that is in contact with and fixed to the flow path unit. The flow path unit has a nozzle plate, an elastic sheet, and a flow path forming plate laminated between the nozzle plate and the elastic sheet. The nozzle plate has a plurality of nozzle openings. The flow path forming plate has a plurality of pressure chambers communicating with the respective nozzle openings and a common ink chamber communicating with each pressure chamber. The nozzle plate and the flow path forming plate are bonded together.

In the head described in JP-A-2000-6397, the common ink chamber is a through hole in the flow path forming plate, and thus if the area of the common ink chamber in plan view is increased, the bonded area of the flow path forming plate and the nozzle plate is reduced. Accordingly, in the head described in JP-A-2000-6397, the adhesive strength of the adhesive bonding the flow path forming plate and the nozzle plate together may be insufficient.

SUMMARY

According to an aspect of the present disclosure, there is provided a liquid ejecting head includes a nozzle plate having a plurality of nozzles, and a flow path plate bonded to one side of the nozzle plate, the flow path plate having flow paths including a liquid reservoir configured to store a liquid to be supplied to the nozzles. The liquid reservoir is defined by a concave portion disposed on a side of the flow path plate opposite to the nozzle plate, a bottom of the concave portion includes a first portion along a periphery of the concave portion and a second portion inside the first portion in plan view from a thickness direction of the flow path plate, and the thickness of the first portion is thicker than the thickness of the second portion.

According to another aspect of the present disclosure, a liquid ejecting apparatus includes the liquid ejecting head according to the one aspect, and a control circuit configured to control the driving of the liquid ejecting head.

DESCRIPTION OF EXEMPLARY EMBODIMENTS

Figure 1:
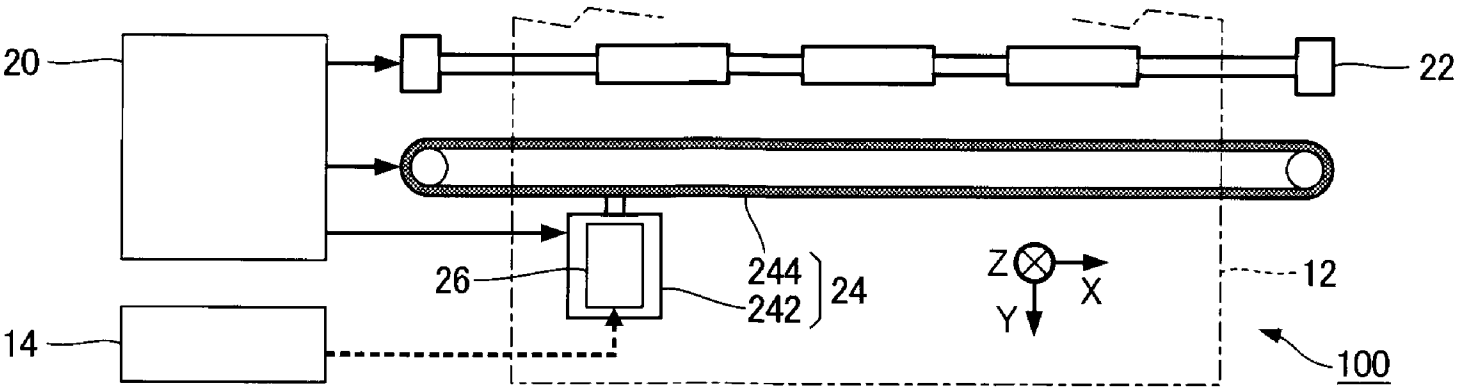
FIG. 1 illustrates a schematic structure of a liquid ejecting apparatus according to a first embodiment.

Hereinafter, embodiments of the present disclosure will be described in detail with reference to the attached drawings. In the drawings, the dimensions and scale of each section may be appropriately changed from actual ones, and may be schematically illustrated to facilitate understanding. It should be noted that in the following description, the scope of the present disclosure is not limited to the embodiments unless such limitations are explicitly mentioned.

1. First Embodiment

1-1. Overall Structure of Liquid Ejecting Apparatus

FIG. 1 illustrates a schematic structure of a liquid ejecting apparatus 100 according to a first embodiment. The liquid ejecting apparatus 100 according to the first embodiment is an ink jet printing apparatus that ejects an ink that is an example liquid to a medium 12. The medium 12 is typically printing paper; alternatively, a print target of any material such as a plastic film or cloth may be used as the medium 12. As illustrated in FIG. 1, to the liquid ejecting apparatus 100, a liquid container 14 for storing ink is disposed. The liquid container 14 may be a cartridge that is detachably attached to the liquid ejecting apparatus 100, a pouch-shaped ink pack made of a flexible film, or an ink tank that can be refilled with ink.

As illustrated in FIG. 1, the liquid ejecting apparatus 100 includes a control unit 20, a transport mechanism 22, a moving mechanism 24, and a liquid ejecting head 26. The control unit 20 is an example control circuit for controlling the driving of the liquid ejecting head 26. The control unit 20 includes, for example, a processing circuit such as a central processing unit (CPU), a field programmable gate array (FPGA), or the like and a storage circuit such as a semiconductor memory. The control unit 20 performs overall control of the components in the liquid ejecting apparatus 100. The transport mechanism 22 transports a medium 12 in a Y direction under the control of the control unit 20.

The moving mechanism 24 transports the liquid ejecting head 26 in an X direction under the control of the control unit 20. The X direction intersects the Y direction in which the medium 12 is transported, typically, a direction that is orthogonal to the Y direction. The moving mechanism 24 according to the first embodiment includes a carriage 242 having a substantially box shape for accommodating the liquid ejecting head 26, and a transport belt 244 to which the carriage 242 is fixed. Note that a plurality of liquid ejecting heads 26 may be mounted on the carriage 242, or the liquid container 14 may be mounted on the carriage 242 together with the liquid ejecting head 26.

The liquid ejecting head 26 ejects an ink supplied from the liquid container 14 to the medium 12 from a plurality of nozzles under the control of the control unit 20. The liquid ejecting head 26 ejects the ink onto the medium 12 simultaneously with the transport of the medium 12 by the transport mechanism 22 and the reciprocating motion of the carriage 242, and thereby an image is formed on the medium 12.

1-2. Overall Structure of Liquid Ejecting Head

Figure 2:
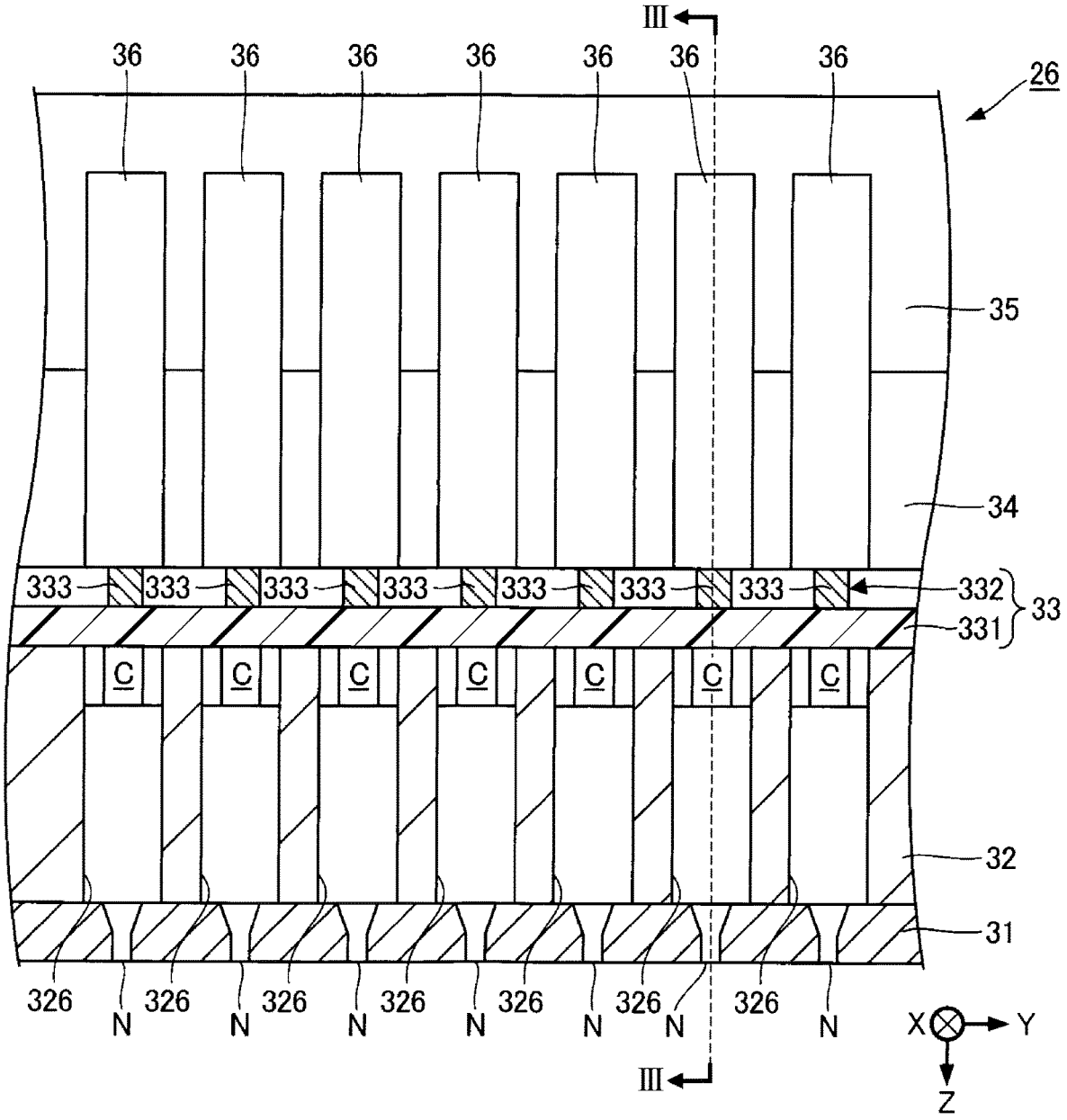
FIG. 2 is a cross-sectional view illustrating a liquid ejecting head according to the first embodiment.
Figure 3:
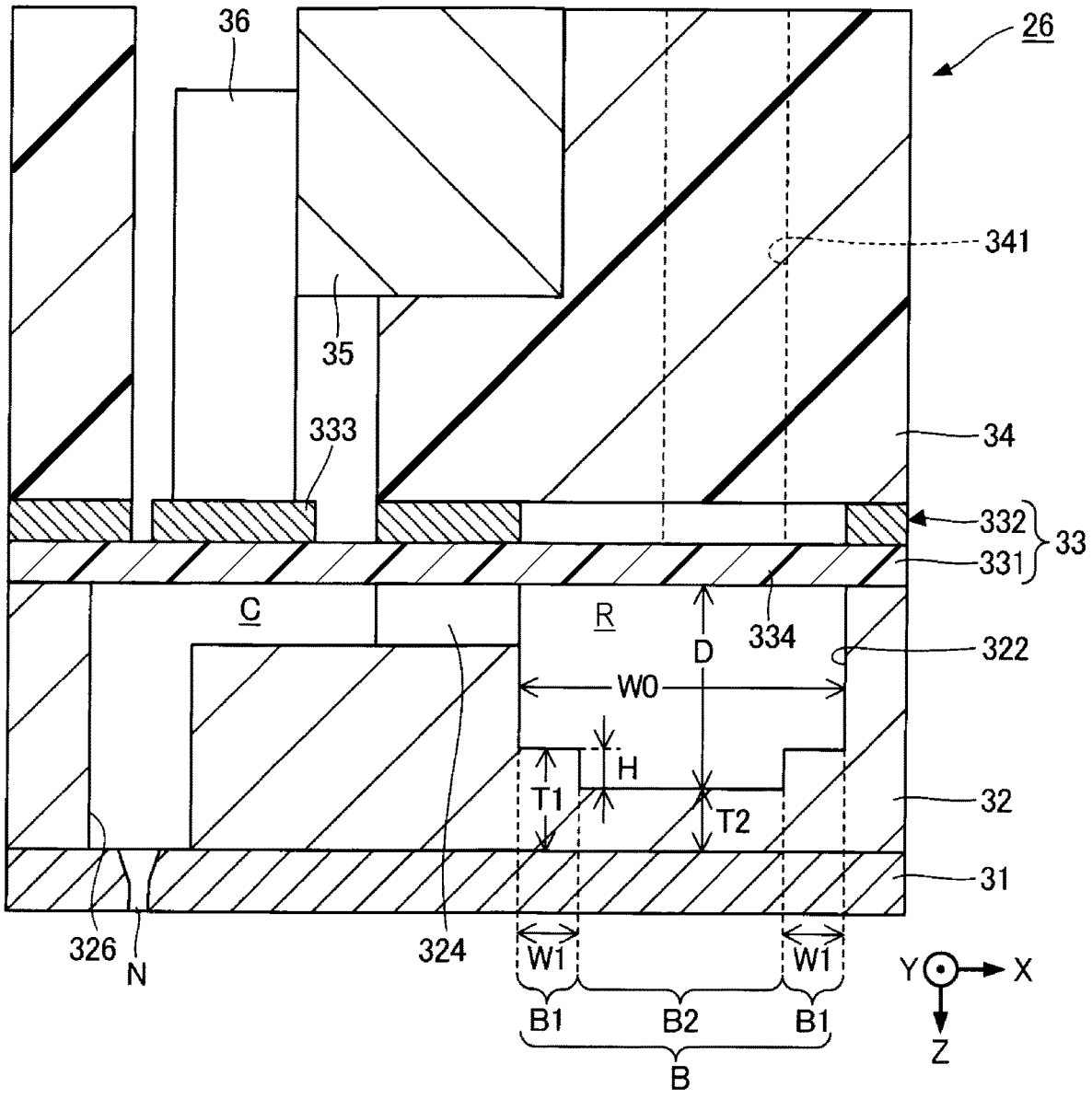
FIG. 3 is a cross-sectional view taken along the line III-III in FIG. 2.

FIG. 2 is a cross-sectional view illustrating the liquid ejecting head 26 according to the first embodiment. FIG. 3 is a cross-sectional view taken along the line III-III in FIG. 2. As illustrated in FIG. 2 and FIG. 3, a direction perpendicular to an X-Y plane is expressed as a Z direction. A direction toward which the liquid ejected head 26 ejects the ink, typically, the vertical direction, corresponds to the Z direction. FIG. 2 is a cross-sectional view parallel to a Y-Z plane, and FIG. 3 is a cross-sectional view parallel to an X-Z plane.

As illustrated in FIG. 2 and FIG. 3, the liquid ejecting head 26 includes a nozzle plate 31, a flow path plate 32, a diaphragm 33, a case 34, a fixing member 35, and a plurality of piezoelectric elements 36. These components are bonded together, for example, with an adhesive. The nozzle plate 31 is bonded to a positive side of the flow path plate 32 in the Z direction, and the diaphragm 33 is bonded to a negative side of the flow path plate 32 in the Z direction. The nozzle plate 31 is a plate-like member having a plurality of nozzles N in the Y direction. Each nozzle N is a through hole through which an ink passes. The Y direction may also be referred to as a direction in which the plurality of nozzles N are arranged. The nozzle plate 31 is made of a metal material such as a stainless steel. For example, the nozzle plate 31 can be manufactured by processing a metal plate by dry etching. The material of the nozzle plate 31 and the method of manufacturing the nozzle plate 31 are not particularly limited, and any material and method may be used. For example, the nozzle plate 31 may be formed by processing a silicon single crystal substrate by a semiconductor manufacturing technique such as etching.

The flow path plate 32 is a plate-like member that forms ink flow paths. As illustrated in FIG. 3, the flow path plate 32 has a liquid reservoir R, a first flow path 324, a pressure chamber C, and a second flow path 326. The liquid reservoir R is defined by a concave portion 322 that is disposed on the negative side of the flow path plate 32 in the Z direction. The concave portion 322 is a space that is recessed with respect to the negative side of the flow path plate 32 in the Z direction. The liquid reservoir R is a common liquid chamber that extends through a plurality of nozzles N. The first flow path 324, the second flow path 326, and the pressure chamber C are provided for each nozzle N. The pressure chamber C is a space between the nozzle plate 31 and the diaphragm 33 for applying pressure to the ink filled in the pressure chamber C. The first flow path 324 is a throttle flow path that communicates with the pressure chamber C and the liquid reservoir R. The first flow path 324 according to the embodiment is defined by a concave portion that is provided on the negative side of the flow path plate 32 in the Z direction. The ink stored in the liquid reservoir R is branched into the first flow paths 324 and the pressure chambers C are supplied and refilled with the ink in parallel. The second flow path 326 is a through hole that communicates with the pressure chamber C and the nozzle N. For example, the second flow path plate 32 may be formed by processing a silicon (Si) single crystal substrate by a semiconductor manufacturing technique such as etching.

A bottom B of the concave portion 322 defining the liquid reservoir R, that is, a portion between the positive side of the flow path plate 32 in the Z direction and the bottom of the concave portion 322, includes a first portion B1 along a periphery of the concave portion 322 and a second portion B2 inside the first portion B1 in plan view from a thickness direction of the flow path plate 32. A thickness T1 of the first portion B1 is thicker than a thickness T2 of the second portion B2. The relation between the thickness T1 and the thickness T2 increases the adhesion reliability between the nozzle plate 31 and the flow path plate 32 while ensuring the necessary volume of the liquid reservoir R. The bottom B will be described in detail below in "1-3. Detailed Description of Liquid Reservoir".

The diaphragm 33 includes an elastic film 331 and a support plate 332. The elastic film 331 is bonded to a side of the flow path plate 32, and the support plate 332 is laminated on the elastic film 331. The elastic film 331 may be made of, for example, a resin material such as a para-aramid resin. The support plate 332 may be made of, for example, a metal material such as a stainless steel. The support plate 332 has an island-shaped portion 333 that overlaps each pressure chamber C. The support plate 332 is removed in an area overlapping the liquid reservoir R. With this structure, in the area, the diaphragm 33 has the single layer of the elastic film 331 and functions as an elastic compliance film 334. The elastic compliance film 334 is a part of a wall surface that defines the liquid reservoir R, and absorbs pressure fluctuations in the liquid reservoir R.

The case 34 is, for example, a structure formed by injection molding using a resin material, and bonded to a side of the diaphragm 33 opposite to the flow path plate 32. As illustrated in FIG. 3, the case 34 has an inlet 341. The inlet 341 is a through hole that communicates with the above-described liquid reservoir R. The inlet 341 introduces the ink from the liquid container 14 in FIG. 1 to the liquid reservoir R.

The fixing member 35 is a member for attaching the piezoelectric element 36 to the case 34, and fixed to the case 34 by an adhesive, or the like. The piezoelectric element 36 is a longitudinal vibration drive element having alternately laminated piezoelectric layers and electrode layers (not illustrated), and an end portion of the piezoelectric element 36 is in contact with the island-shaped portion 333. Vibration of the island-shaped portion 333 and the elastic film 331 caused by deformations of the piezoelectric element 36 changes the volume in the pressure chamber C, causing the ink to be ejected from the nozzle N.

Although not illustrated, a wiring board is connected to the piezoelectric elements 36 by soldering or the like. The wiring board is a mounting component that has a plurality of wires that electrically connect the control unit 20 and the liquid ejecting head 26. Specifically, the wiring board provides drive signals for driving the piezoelectric elements 36 to the individual piezoelectric elements 36. The wiring board may be a flexible wiring board, for example, a flexible printed circuit (FPC) or a flexible flat cable (FFC).

As described above, the liquid ejecting apparatus 100 includes the liquid ejecting head 26, and the control unit 20 that is the control circuit for controlling the driving of the liquid ejecting head 26. In the liquid ejecting head 26, the liquid reservoir R is defined by the concave portion 322, and the thickness T1 of the first portion B1 of the bottom B of the concave portion 322 is thicker than the thickness T2 of the second portion B2. With this structure, the adhesion reliability between the nozzle plate 31 and the flow path plate 32 can be increased while ensuring the necessary volume in the liquid reservoir R in the liquid ejecting head 26.

1-3. Detailed Description of Liquid Reservoir

Figure 4:
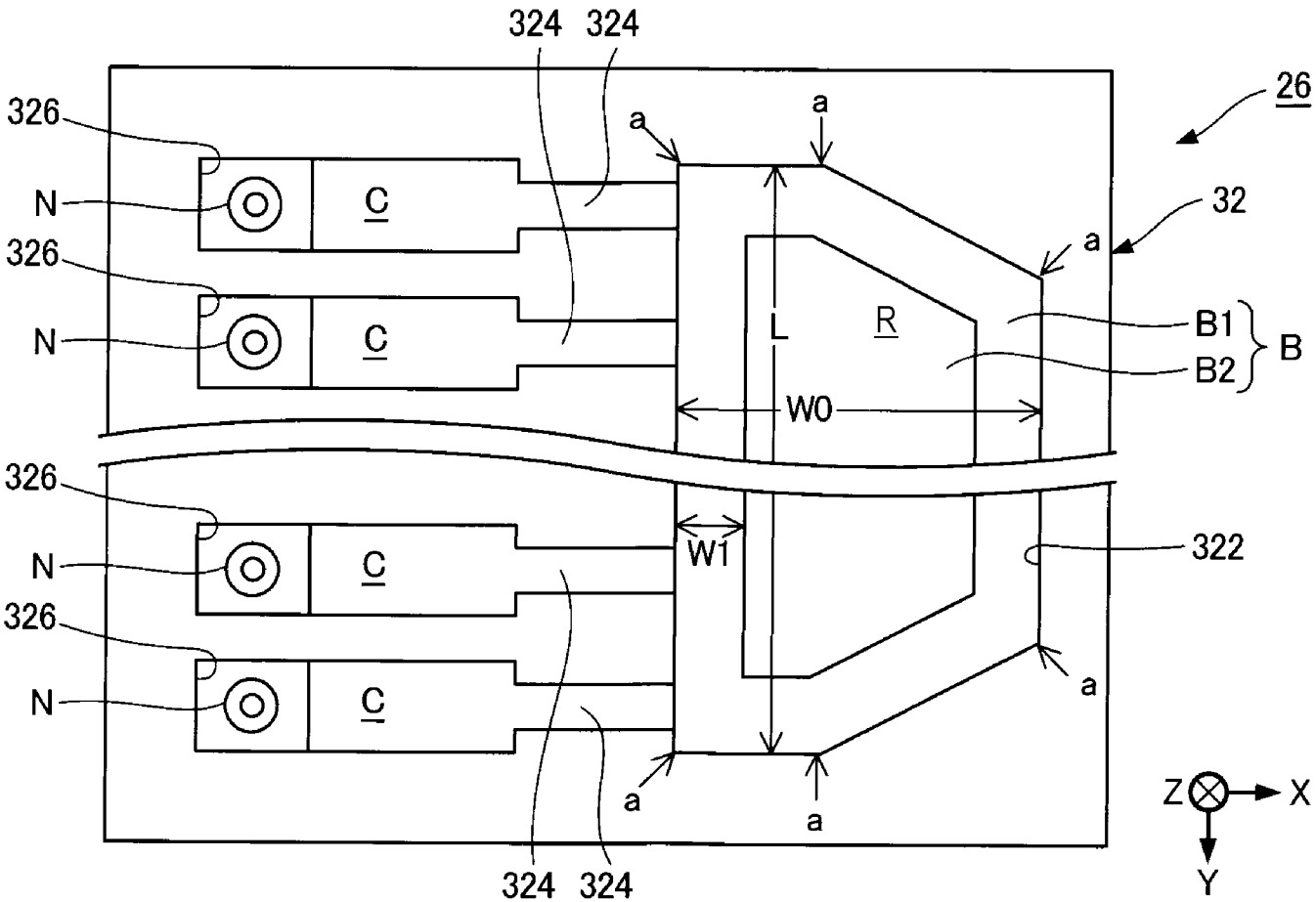
FIG. 4 is a plan view illustrating a flow path plate according to the first embodiment.

FIG. 4 is a plan view illustrating the flow path plate 32 according to the first embodiment. Hereinafter, the liquid reservoir R will be described in detail with reference to FIG. 3 and FIG. 4.

As illustrated in FIG. 3 and FIG. 4, the liquid ejecting head 26 includes the nozzle plate 31 having the nozzles N and the flow path plate 32 having the flow paths including the liquid reservoir R for storing a liquid to be supplied to the nozzles N. As illustrated in FIG. 3, the flow path plate 32 is bonded to the one side of the nozzle plate 31. The bonding is performed, for example, by using an adhesive. The adhesive may be any adhesive, for example, an epoxy adhesive, an urethane adhesive, or the like may be used. The adhesive may be, for example, a filler of silica or alumina.

As illustrated in FIG. 3 and FIG. 4, the concave portion 322 is provided on the side of the flow path plate 32 opposite to the nozzle plate 31. The concave portion 322 defines the liquid reservoir R. Accordingly, by the use of the bottom B of the concave portion 322 for the bonding to the nozzle plate 31, as compared to the case in which the liquid reservoir R is formed by a through hole in the flow path plate 32, the bonded area between the nozzle plate 31 and the flow path plate 32 can be increased. With this structure, the adhesive strength of the adhesion that bonds the nozzle plate 31 and the flow path plate 32 can be increased. Furthermore, the liquid reservoir R defined by the concave portion 322 prevents or reduces the exposure of the adhesive to the liquid in the liquid reservoir R, and thus the deterioration of the adhesive due to the liquid can be prevented or reduced. Accordingly, a wide variety of usable liquids and adhesives can be provided.

As illustrated in FIG. 4, the bottom B of the concave portion 322 includes the first portion B1 along the periphery of the concave portion 322 and the second portion B2 inside the first portion B1 in plan view from the thickness direction of the flow path plate 32. In this embodiment, the second portion B2 is surrounded by the first portion B1 in plan view. As illustrated in FIG. 3, the thickness T1 of the first portion B1 is thicker than the thickness T2 of the second portion B2. With this structure, a step exists between the first portion B1 and the second portion B2 on the side of the bottom B opposite to the nozzle plate 31. Here, the thickness T1 is a maximum value of the length of the first portion B1 in the Z direction. The thickness T2 is a maximum value of the length of the second portion B2 in the Z direction.

The partly thickened bottom B increases the mechanical strength of the bottom B while ensuring the necessary volume of the liquid reservoir R. Accordingly, even if a thermal stress or the like due to a difference between linear expansion coefficients of the nozzle plate 31 and the flow path plate 32 is produced in the bottom B, the occurrence of cracks or the like in the bottom B can be reduced. Since the first portion B1 thicker than the second portion B2 extends along the periphery of the concave portion 322 in plan view, the bottom B of the concave portion 322 defining the liquid reservoir R can be appropriately reinforced with the first portion B1. With this structure, the occurrence of cracks or the like in the bottom B can be appropriately reduced. In this embodiment, the periphery of the concave portion 322 and the periphery of the bottom B are substantially the same in plan view; however, the structure is not limited to this example, and the periphery of the concave portion 322 may be located outside the periphery of the bottom B.

As mentioned above, the nozzle plate 31 is, for example, a metal material such as a stainless steel, and the flow path plate 32 is, for example, a silicon single crystal substrate. For example, the linear expansion coefficient of stainless steel SUS304 is $17.3\times10^{-6}$/K. The linear expansion coefficient of single crystal silicon is $2.4\times10^{-6}$/K. Accordingly, the linear expansion coefficient of the material of the flow path plate 32 is smaller than the linear expansion coefficient of the material of the nozzle plate 31. In this case, the thermal stress produced in the bottom B of the concave portion 322 defining the liquid reservoir R tends to increase. Consequently, in this case, the bottom B reinforced with the first portion B1 is particularly effective to reduce the occurrence of cracks or the like in the bottom B. Note that, the linear expansion coefficient of the material of the flow path plate 32 may be the same as or larger than the linear expansion coefficient of the material of the nozzle plate 31. Accordingly, the difference between the linear expansion coefficient of the material of the flow path plate 32 and the linear expansion coefficient of the material of the nozzle plate 31 is, although not particularly limited, for example, 0/K or more and $15\times10^{-6}$/K or less.

As illustrated in FIG. 4, the periphery of the bottom B in plan view forms a pentagon including five corners a. The first portion B1 surrounds the periphery of the bottom B in plan view. If the periphery of the bottom B in plan view has a shape including a plurality of corners a, at each corner, a stress concentration causing cracks in the bottom B tends to occur. To solve the problem, the first portion B1 is disposed along the area including the corners a in the periphery of the bottom B in plan view. With this structure, the portions at which the stress concentration tends to occur in the bottom B can be effectively reinforced with the first portion B1. The first portion B1 may be, for example, disposed in a part of the periphery of the bottom B as in a second modification which will be described below.

The concave portion 322 has a longitudinal shape extending in the Y direction. Accordingly, a length L of the concave portion 322 along the Y direction is longer than a width W0 of the concave portion 322 along the X direction. With this structure, the number of nozzles N for one liquid reservoir R can be increased while the size of the liquid ejecting head 26 can be reduced. The ratio L/W0 of the length L and the width W0 may be any ratio, and for example, may be in the range of 5 to 50. When the flow path plate 32 is made of, for example, a silicon single crystal substrate by anisotropic etching, a wall surface that defines the concave portion 322 is formed along a crystal plane of silicon. Note that shapes of the concave portion 322 and the bottom B in plan view are not limited to the shapes illustrated in FIG. 4, and for example, may be a polygon other than the pentagon. Furthermore, the concave portion 322 may be formed in any shape by dry etching or the like. The width W0 can be considered as a maximum value of the length of the concave portion 322 in the direction orthogonal to the longitudinal direction in plan view.

The difference between the thickness T1 of the first portion B1 and the thickness T2 of the second portion B2, that is, a height H of the step with the first portion B1 is preferably 50% or less with respect to a depth D of the concave portion 322, more preferably 5% or more and 50% or less, and more preferably 10% or more and 40% or less. When the height H is within the ranges, the volume of the liquid reservoir R can be readily increased. In this respect, a specific height H is preferably 50 μm or more and 200 μm or less, and more preferably 70 μm or more and 150 μm or less.

On the other hand, if the height H is too high, depending on the width W1 of the first portion B1, it may be difficult to ensure the necessary volume of the liquid reservoir R. Furthermore, if the height H is too high, the stress concentration in the boundary between the first portion B1 and the second portion B2 tends to occur and the effect of reducing the occurrence of cracks or the like in the bottom B may decrease. Furthermore, if the height H is too high, crosstalk between the two adjacent nozzles N tends to occur, and the image quality may be decreased. On the other hand, if the height H is too short, depending on the depth D or the like, the reinforcing effect of the bottom portion B with the first portion B1 may be insufficient.

The width W1 of the first portion B1 is preferably 25% or less with respect to the width W0 of the concave portion 322, more preferably 5% or more and 25% or less, and more preferably 5% or more and 20% or less. When the width W1 is within the ranges, the volume of the liquid reservoir R can be readily increased. In this respect, a specific width W1 is preferably 150 μm or more and 400 μm or less, and more preferably 200 μm or more and 300 μm or less.

On the other hand, if the width W1 of the first portion B1 is too wide, depending on the difference between the thickness T1 of the first portion B1 and the thickness T2 of the second portion B2, that is, the height H of the step, it may be difficult to ensure the necessary volume of the liquid reservoir R. Furthermore, if the width W1 of the first portion B1 is too wide, crosstalk between the two adjacent nozzles tends to occur, and the image quality may be decreased.

The thickness T1 of the first portion B1 is preferably 50 μm or more, more preferably 5 μm or more and 50 μm or less, and more preferably 10 μm or more and 40 μm or less. When the thickness T1 is within the ranges, the occurrence of cracks or the like in the bottom B can be readily reduced. On the other hand, when the thickness T1 is too thin, depending on the material of the flow path plate 32, the mechanical strength of the bottom B may be insufficient.

The thickness T2 of the second portion B2 is preferably 50 μm or more and 200 μm or less, and more preferably 70 μm or more and 150 μm or less. When the thickness T2 is within the ranges, both of the increase in volume of the liquid reservoir R and the reduction in the occurrence of cracks or the like in the bottom B can be readily achieved.

2. Second Embodiment

Hereinafter, a second embodiment of the present disclosure will be described. In the following examples, the reference numerals used in the first embodiment will be used to components that function similarly to those in the first embodiment, and detailed descriptions of the components will be omitted as appropriate.

Figure 5:
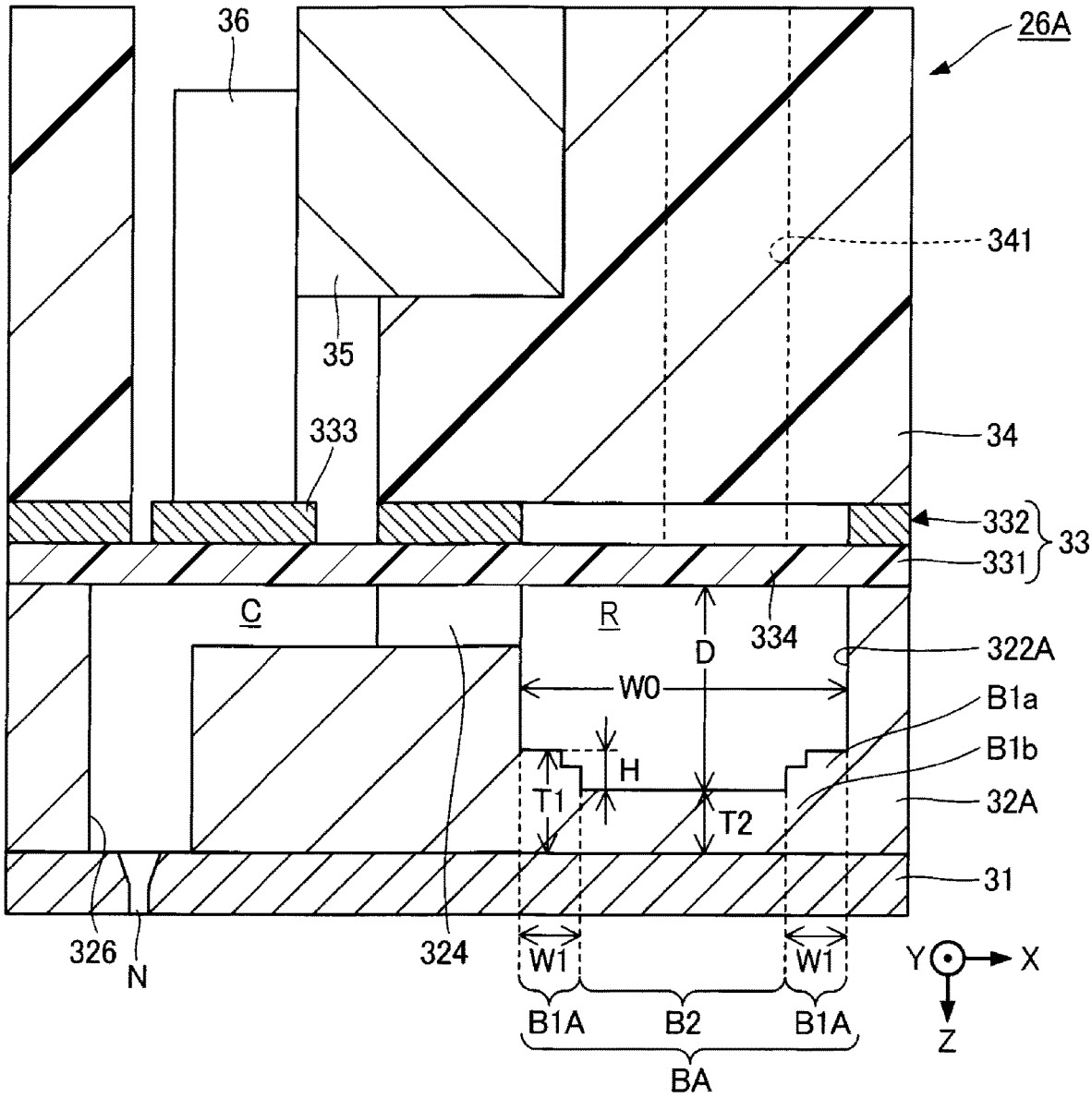
FIG. 5 is a cross-sectional view illustrating a liquid ejecting head according to a second embodiment.
Figure 6:
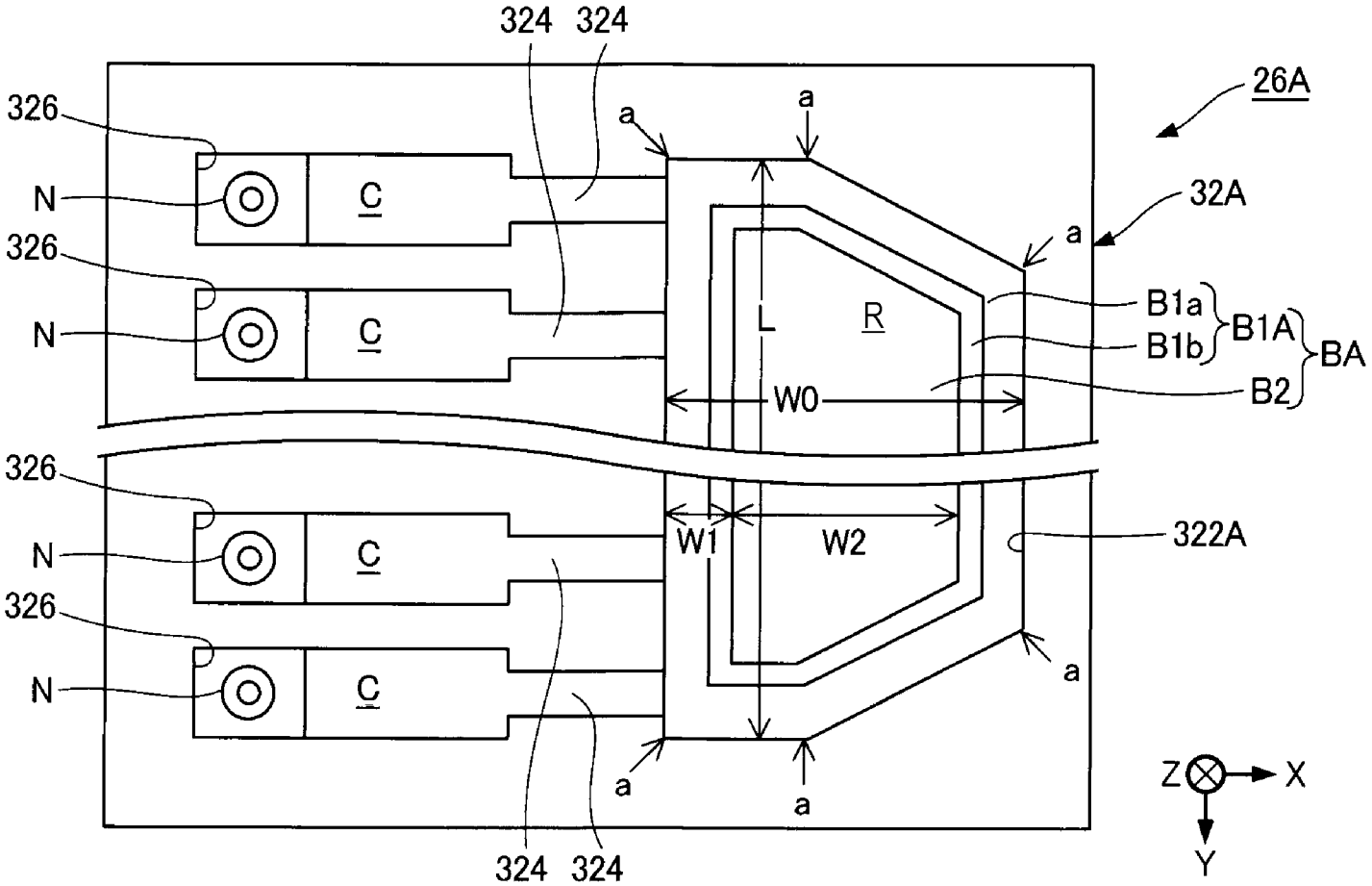
FIG. 6 is a plan view illustrating a flow path plate according to the second embodiment.

FIG. 5 is a cross-sectional view illustrating a liquid ejecting head 26A according to a second embodiment. FIG. 6 is a plan view illustrating a flow path plate 32A according to the second embodiment. The liquid ejecting head 26A illustrated in FIG. 5 is similar to the liquid ejecting head 26 according to the first embodiment except that the liquid ejecting head 26A includes the flow path plate 32A instead of the flow path plate 32 according to the first embodiment. A concave portion 322A defining the liquid reservoir R is provided on a side of the flow path plate 32A opposite to the nozzle plate 31.

As illustrated in FIG. 6, a bottom BA of the concave portion 322A includes a first portion B1A along the periphery of the concave portion 322A and a second portion B2 inside the first portion B1A in plan view from the thickness direction of the flow path plate 32A. As illustrated in FIG. 5, the thickness T1 of the first portion B1A is thicker than the thickness T2 of the second portion B2. Accordingly, effects similar to those in the above-described first exemplary embodiment can be obtained. In this embodiment, the first portion B1A has two portions B1*a* and B1*b* having different thicknesses.

With this structure, the thickness T1 of the first portion B1A decreases stepwise toward the second portion B2. Accordingly, even if the difference between the thickness T1 of the first portion B1A and the thickness T2 of the second portion B2 is increased, the stress concentration in the boundary between the first portion B1A and the second portion B2 can be reduced. As a result, the bottom BA of the concave portion 322A defining the liquid reservoir R can be appropriately reinforced with the first portion B1A. In the example illustrated in FIG. 5 and FIG. 6, the first portion B1A has the two portions B1*a* and B1*b* having different thicknesses. Alternatively, the number of the portions having different thicknesses in the first portion B1A may be three or more. For example, the thickness of the first portion B1A may be changed at two or more steps from the outer periphery toward the inner periphery of the first portion B1A. Alternatively, as in a first modification described below, the thickness of the first portion B1A may be continuously changed from the outer periphery toward the inner periphery of the first portion B1A.

Figure 7:
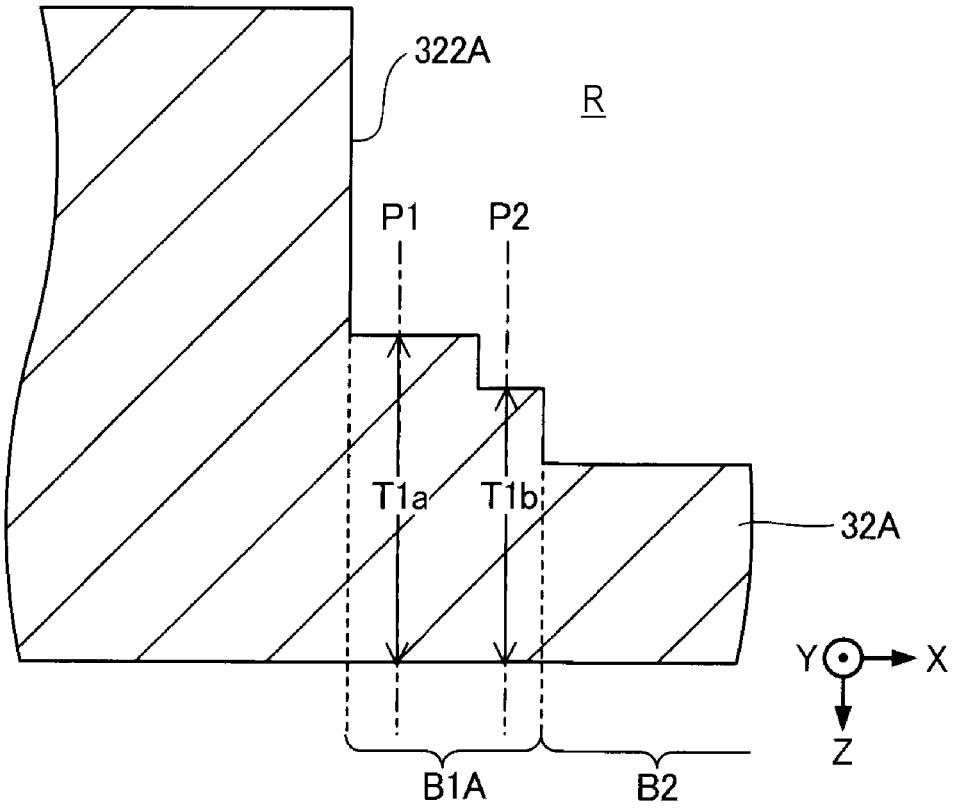
FIG. 7 is an enlarged cross-sectional view of a first portion of a bottom defining a liquid reservoir.

FIG. 7 is an enlarged cross-sectional view of the first portion B1A of the bottom BA defining the liquid reservoir R. As illustrated in FIG. 7, in the first portion B1A, when a first position P1 and a second position P2 closer to the second portion B2 than the first position P1 are set, a thickness T1*b* of the first portion B1A at the second position P2 is thinner than a thickness T1*a* of the first portion B1A at the first position P1. With this structure, when the thickness T1 of the first portion B1A decreases stepwise toward the second portion B2, such a relationship between the thickness T1*a* and the thickness T1*b* is satisfied. Similarly, when the thickness T1 of the first portion B1A decreases continuously toward the second portion B2, such a relationship between the thickness T1*a* and the thickness T1*b* is satisfied.

3. Modifications

The above-described embodiments may be modified in various ways. Specific modifications applicable to the above-described embodiments will be described below. It is to be understood that two or more modifications selected from those below may be combined without a contradiction between them.

3-1. First Modification

Figure 8:
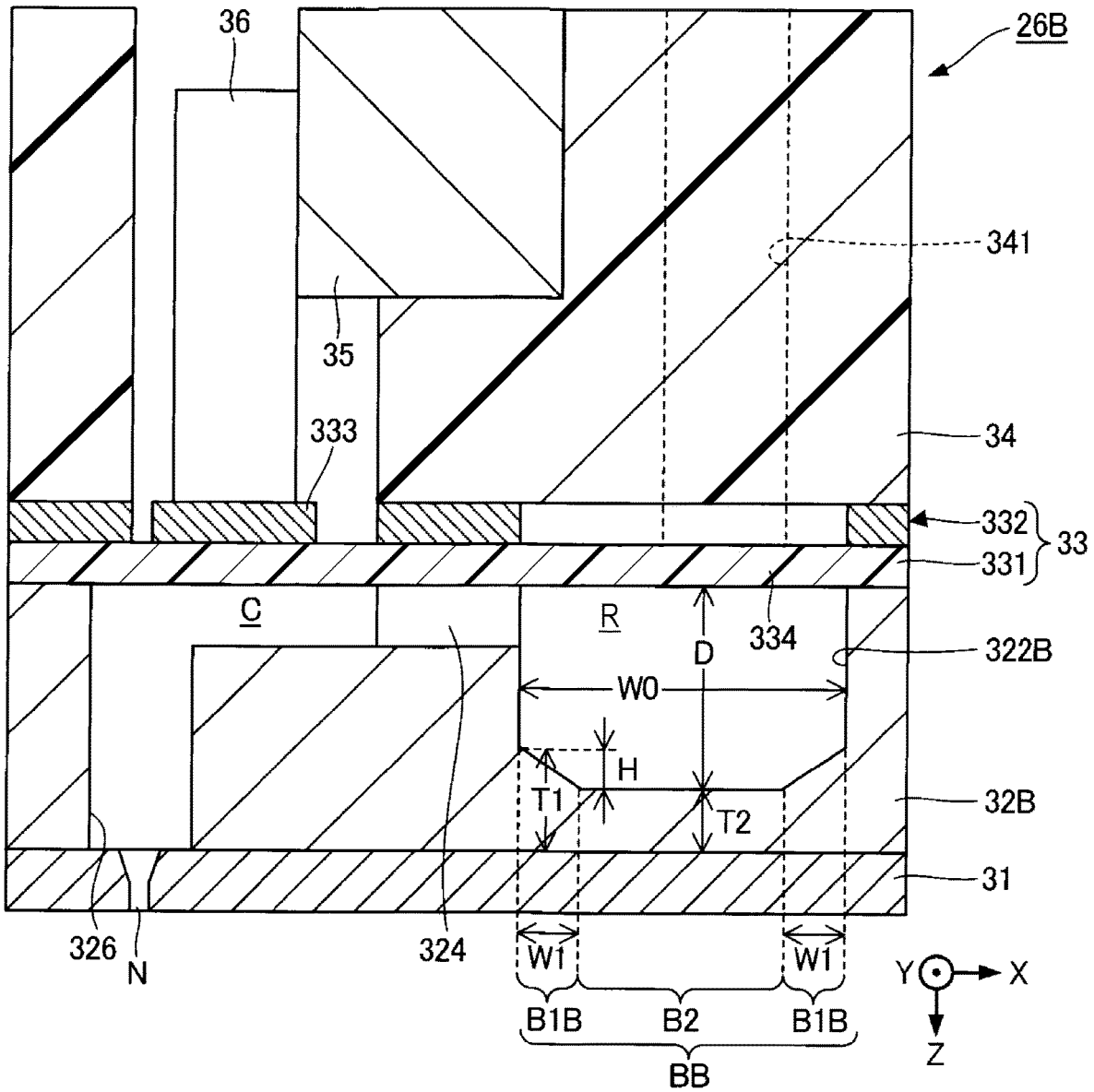
FIG. 8 is a cross-sectional view illustrating a liquid ejecting head according to a first modification.

FIG. 8 is a cross-sectional view illustrating a liquid ejecting head 26B according to a first modification. The liquid ejecting head 26B illustrated in FIG. 8 is similar to the liquid ejecting head 26 according to the first embodiment except that the liquid ejecting head 26B includes a flow path plate 32B instead of the flow path plate 32 according to the first embodiment. A concave portion 322B defining the liquid reservoir R is provided on a side of the flow path plate 32B opposite to the nozzle plate 31.

A bottom BB of the concave portion 322B includes a first portion B1B along the periphery of the concave portion 322B and a second portion B2 inside the first portion B1B in plan view from the thickness direction of the flow path plate 32B. As illustrated in FIG. 8, the thickness T1 of the first portion B1B is thicker than the thickness T2 of the second portion B2. Accordingly, effects similar to those in the above-described first exemplary embodiment can be obtained. Furthermore, the thickness T1 of the first portion B1B gradually decreases toward the second portion B2. Accordingly, the effect similar to that in the above-described second embodiment can be obtained. In the example illustrated in FIG. 8, although the thickness of the first portion B1B is changed toward the second portion B2 at a constant rate, the present disclosure is not limited to this example, and the rate can be increased or decreased.

3-2. Second Modification

Figure 9:
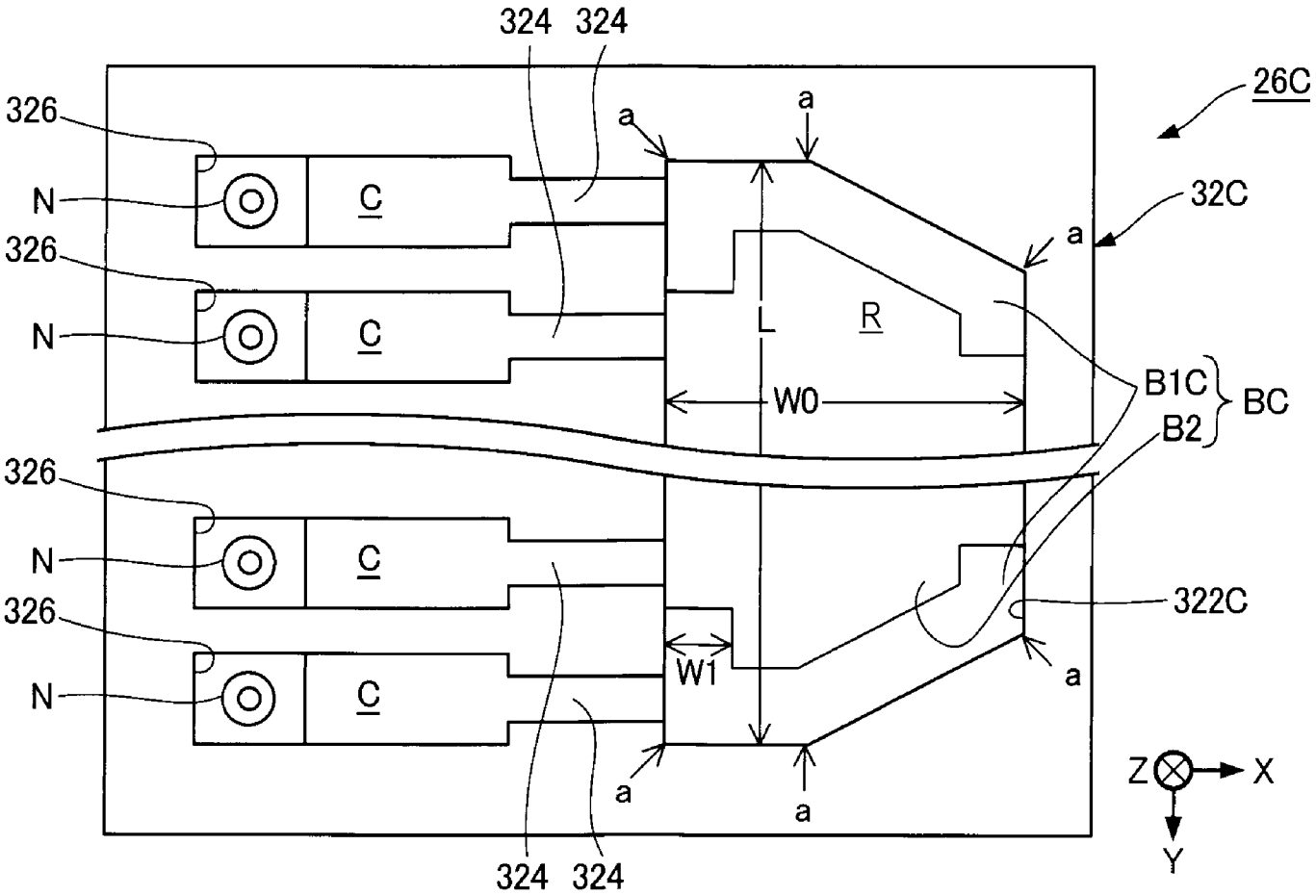
FIG. 9 is a plan view illustrating a flow path plate in a liquid ejecting head according to a second modification.

FIG. 9 is a plan view illustrating a flow path plate 32C in a liquid ejecting head 26C according to a second modification. The liquid ejecting head 26C illustrated in FIG. 9 is similar to the liquid ejecting head 26 according to the first embodiment except that the liquid ejecting head 26C includes the flow path plate 32C instead of the flow path plate 32 according to the first embodiment. A concave portion 322C defining the liquid reservoir R is provided in the flow path plate 32C.

A bottom BC of the concave portion 322C includes a first portion B1C along the periphery of the concave portion 322C and a second portion B2 inside the first portion B1C in plan view from the thickness direction of the flow path plate 32C. The thickness of the first portion B1C is thicker than the thickness of the second portion B2. Accordingly, the effects similar to those in the above-described first embodiment can be obtained. In this modification, the first portion B1C is disposed in a part of the periphery of the bottom BC. More specifically, the first portion B1C includes separately provided two portions on both ends of the longitudinal bottom BC. The first portion B1C is disposed along the area including the corners a in the periphery of the bottom BC in plan view. Accordingly, the bottom BC can be appropriately reinforced with the first portion B1C.

3-3. Third Modification

Figure 10:
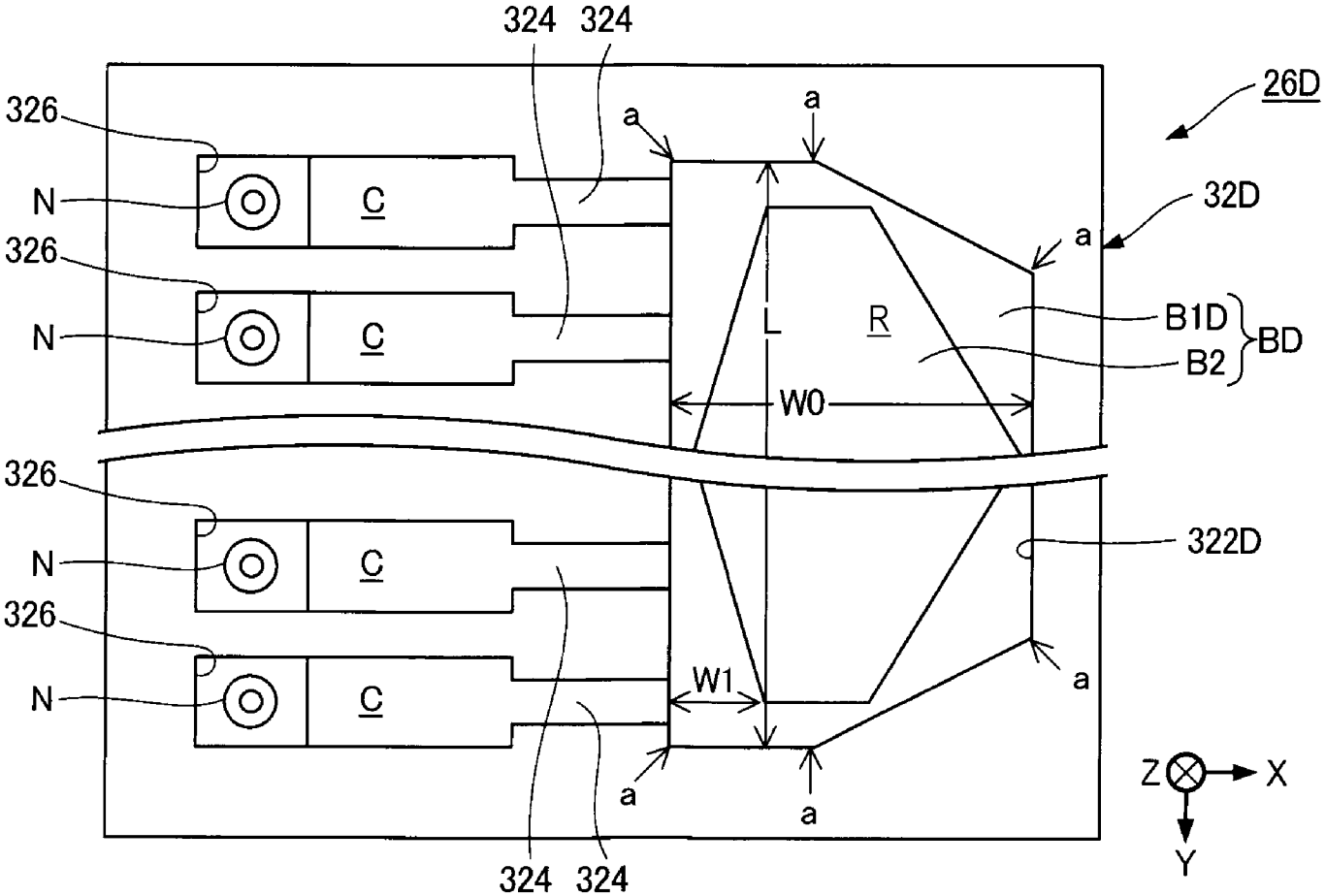
FIG. 10 is a plan view illustrating a flow path plate in a liquid ejecting head according to a third modification.

FIG. 10 is a plan view illustrating a flow path plate 32D in a liquid ejecting head 26D according to a third modification. The liquid ejecting head 26D illustrated in FIG. 10 is similar to the liquid ejecting head 26 according to the first embodiment except that the liquid ejecting head 26D includes the flow path plate 32D instead of the flow path plate 32 according to the first embodiment. A concave portion 322D defining the liquid reservoir R is provided in the flow path plate 32D.

A bottom BD of the concave portion 322D includes a first portion B1D along the periphery of the concave portion 322D and a second portion B2 inside the first portion B1D in plan view from the thickness direction of the flow path plate 32D. The thickness of the first portion B1D is thicker than the thickness of the second portion B2. Accordingly, the effects similar to those in the above-described first embodiment can be obtained. In this modification, a width W1 in the first portion B1D is changed in the circumferential direction. Specifically, in the first portion B1D, in plan view, a width of a portion corresponding to an area including the corner a in the periphery of the bottom BD is wider than widths of other portions. Accordingly, the bottom BD can be appropriately reinforced with the first portion B1D.

3-4. Other Modifications

The above-described embodiments describe the serial liquid ejecting apparatus 100 in which the liquid ejecting head 26 is mounted on the carriage 242 and the carriage 242 is reciprocated. Alternatively, the present disclosure may be applied to a line liquid ejecting apparatus in which a plurality of nozzles N are provided in the whole area in the width direction of a medium 12.

The liquid ejecting apparatus 100 in the above-described embodiments may be employed in devices dedicated for printing and in various devices such as facsimile apparatuses and copying machines. It should be noted that the usage of the liquid ejecting apparatus according to any of the embodiments of the present disclosure is not limited to printing. For example, a liquid ejecting apparatus that ejects solutions of coloring materials can be used as a manufacturing apparatus for forming color filers for liquid crystal display apparatuses. Furthermore, a liquid ejecting apparatus that ejects solutions of conductive materials can be used as a manufacturing apparatus for producing wiring and electrodes of wiring boards.

In the above-described embodiments, the examples of the piezoelectric liquid ejecting heads 26, 26A, 26B, 26C, and 26D are described. Alternatively, the present disclosure may be applied to a thermal liquid ejecting head.

What is claimed is:

1. A liquid ejecting head comprising:

a nozzle plate having a plurality of nozzles; and a flow path plate bonded to one side of the nozzle plate, the flow path plate having flow paths including a liquid reservoir configured to store a liquid to be supplied to the nozzles, wherein the liquid reservoir is defined by a concave portion formed on a side of the flow path plate opposite to the nozzle plate, a bottom of the concave portion includes a first portion along a periphery of the concave portion and a second portion inside the first portion when viewed in a thickness direction of the flow path plate, and the thickness of the first portion is thicker than the thickness of the second portion, wherein the bottom of the liquid reservoir defined by the concave portion is formed on the side of the flow path plate opposite the nozzle plate such that the bottom of the liquid reservoir is separated from the nozzle plate by the thickness of the first and second portions.

2. The liquid ejecting head according to claim 1, wherein the periphery of the bottom has a shape having corners when viewed in the thickness direction of the flow path plate, the first portion is disposed along an area including the corners in the periphery of the bottom when viewed in the thickness direction of the flow path plate.

3. The liquid ejecting head according to claim 1, wherein the thickness of the first portion decreases stepwise or continuously toward the second portion.

4. The liquid ejecting head according to claim 1, wherein a linear expansion coefficient of the material of the flow path plate is smaller than a linear expansion coefficient of the material of the nozzle plate.

5. The liquid ejecting head according to claim 1, wherein a difference between the thickness of the first portion and the thickness of the second portion is 50% or less with respect to a depth of the concave portion.

6. The liquid ejecting head according to claim 1, wherein a width of the first portion is 25% or less with respect to a width of the concave portion when viewed in the thickness direction of the flow path plate.

7. The liquid ejecting head according to claim 1, wherein the thickness of the first portion is 50 μm or more.

8. A liquid ejecting apparatus comprising:

the liquid ejecting head according to claim 1; and a control circuit configured to control the driving of the liquid ejecting head.

9. A liquid ejecting head comprising:

a nozzle plate having a plurality of nozzles; and a flow path plate bonded to one side of the nozzle plate, the flow path plate having flow paths including a liquid reservoir configured to store a liquid to be supplied to the nozzles, wherein the liquid reservoir is defined by a concave portion formed on a side of the flow path plate opposite to the nozzle plate, a periphery of a bottom has a shape having corners when viewed in a thickness direction of the flow path plate, the bottom of the concave portion includes a first portion including an area including the corners in the periphery of the bottom and a second portion that includes a portion inside the first portion when viewed in the thickness direction of the flow path plate, the thickness of the first portion is thicker than the thickness of the second portion, wherein the bottom of the liquid reservoir defined by the concave portion is formed on the side of the flow path plate opposite the nozzle plate such that the bottom of the liquid reservoir is separated from the nozzle plate by the thickness of the first and second portions.

10. A liquid ejecting apparatus comprising:

the liquid ejecting head according to claim 9; and a control circuit configured to control the driving of the liquid ejecting head.

* * * * *